US009356360B1

(12) United States Patent
Buckley et al.

(10) Patent No.: US 9,356,360 B1
(45) Date of Patent: May 31, 2016

(54) DUAL POLARIZED PROBE COUPLED RADIATING ELEMENT

(71) Applicants: Michael J. Buckley, Marion, IA (US); Jeremiah D. Wolf, Marion, IA (US); Matilda G. Livadaru, Marion, IA (US); Christopher G. Olson, Robins, IA (US)

(72) Inventors: Michael J. Buckley, Marion, IA (US); Jeremiah D. Wolf, Marion, IA (US); Matilda G. Livadaru, Marion, IA (US); Christopher G. Olson, Robins, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 133 days.

(21) Appl. No.: 14/504,485

(22) Filed: Oct. 2, 2014

(51) Int. Cl.
*H01Q 15/24* (2006.01)
*H01Q 21/24* (2006.01)

(52) U.S. Cl.
CPC ..... *H01Q 21/245* (2013.01); *H01Q 15/24* (2013.01)

(58) Field of Classification Search
CPC ..... H01Q 21/245; H01Q 15/24; H01Q 9/065
USPC ..... 343/756, 909, 793
See application file for complete search history.

(56) References Cited

U.S. PATENT DOCUMENTS

| | | | | |
|---|---|---|---|---|
| 7,994,984 | B2 * | 8/2011 | Inoue | H01Q 1/243 343/700 MS |
| 2010/0039343 | A1 * | 2/2010 | Uno | H01Q 3/24 343/818 |
| 2012/0154234 | A1 * | 6/2012 | Geiler | H01Q 15/008 343/787 |

* cited by examiner

*Primary Examiner* — Dieu H Duong
(74) *Attorney, Agent, or Firm* — Angel N. Gerdzhikov; Donna P. Suchy; Daniel M. Barbieri

(57) ABSTRACT

An electronically scanned array radiating element includes a ground plane layer having a pair of conductive probes. A metallization layer is coupled with the ground plane layer and includes a first asymmetric cluster including HOF scattering members and impedance-matching dipoles. A first electrically-large impedance-matching dipole is coupled with one of the conductive probes and is associated with the first asymmetric cluster. The first electrically-large impedance-matching dipole and the first asymmetric cluster may cooperate with one another to produce a signal. A second asymmetric cluster includes HOF scattering members and impedance-matching dipoles. A second electrically-large impedance-matching dipole is coupled with the other conductive probe and is associated with the second asymmetric cluster. The electrically-large impedance-matching dipole and the asymmetric cluster may cooperate with one another to produce a second signal having a polarization orthogonal to the polarization of the first signal.

17 Claims, 5 Drawing Sheets

DUAL POLARIZED PROBE COUPLED RADIATING ELEMENT

BACKGROUND

Existing planar radiating element and manifold technology using high dielectric constant materials cannot provide an integrated manifold and radiating element feed layer and good scan and polarization performance. Conventional probe fed patch apertures have gain and polarization limitations. Electronically scanned arrays often employ a circularly polarized field for satellite communication. Single linear polarization imposes inherent limitations on satellite communication. Dual polarization, with signals 90° out of phase, would be preferable if it could be achieved per-unit-cell in the array.

Electronically scanned antennas are fabricated as multilayer printed wiring boards and generally include a feed layer and a manifold layer for distributing power to the feed layer. The feed layer feeds power to an aperture layer that couples the power to free space. The aperture layer typically requires low dielectric constant materials that are unsuitable for standard printed wiring board manufacturing processes. Further, existing aperture layers are substantially thicker than the manifold or feed layers, creating an unbalanced printed circuit board.

Probe fed apertures generally include a low dielectric constant substrate and two printed circuit board patches. Patches tend to scatter into lower order Floquet modes. Lower order Floquet modes must be relatively constant over the scan volume and frequency band, necessitating a small unit cell size and a low dielectric constant substrate. The small unit cell size results in a high module density, significantly increasing the cost of the antenna and increasing the heat dissipation problems. Further, aperture performance as a function of frequency and scan angle is sub-optimal. Cross-polar coupling at wide H-plane scan angles is also high because the probe is asymmetrical with respect to the H-plane.

Probe coupled radiating elements combine the manifold and feed layers of a comparable aperture coupled radiating element resulting in a significant reduction in cost and manufacturing complexity. Current planar radiating element technology cannot provide a relatively broadband (−30%) probe coupled dual polarized radiating element comprised exclusively of epoxy-based printed circuit board materials (e.g., FR-4), manufactured using standard printed circuit board (PCB) processes, and with a built in radome. Conventional probe coupled radiating elements require higher cost polytetrafluoroethylene-based materials that are more expensive and difficult to manufacture than epoxy-based materials (e.g., FR-4). In addition, the unit cell size of a conventional probe coupled radiating element is small. Small unit cell size radiating elements are more expensive, and create module count, packaging, and heat dissipation problems.

SUMMARY

In one aspect, the inventive concepts disclosed herein are directed to an electronically scanned array radiating element. The radiating element includes a ground plane layer having a pair of conductive probes. A metallization layer is coupled with the ground plane layer and includes a first asymmetric cluster including Higher-Order Floquet (HOF) scattering members and impedance-matching dipoles. A first electrically-large impedance-matching dipole is coupled with one of the conductive probes and is associated with the first asymmetric cluster. The first electrically-large impedance-matching dipole and the first asymmetric cluster may cooperate with one another to produce a first signal. The metallization layer also includes a second asymmetric cluster including HOF scattering members and impedance-matching dipoles. A second electrically-large impedance-matching dipole having an orientation substantially orthogonal to the orientation of the first electrically-large impedance-matching dipole is coupled with the other conductive probe and is associated with the second asymmetric cluster. The second electrically-large impedance-matching dipole and the second asymmetric cluster cooperate with one another to produce a second signal having a polarization orthogonal to the polarization of the first signal.

In some embodiments, the radiating element may also include a second metallization layer positioned between the ground plane layer and the metallization layer. The second metallization layer may include HOF scattering members. A pair of probe receiving spaces may be coupled with the pair of conductive probes. A first cluster of impedance-matching dipoles may be associated with one of the probe receiving spaces and may be configured to cooperate with a first set of the HOF scattering members to produce a third signal having the same polarization as the polarization of the first signal. A second cluster of impedance-matching dipoles may be associated with the other probe-receiving space and may be configured to cooperate with a second set of the HOF scattering members to produce a fourth signal having the same polarization as the polarization of the second signal.

In some embodiments, the radiating element may further include a third metallization layer positioned between the ground plane layer and the second metallization layer. The third metallization layer may include HOF scattering members and a first impedance-matching dipole associated with the first conductive probe and having the first orientation. The first impedance-matching dipole may be configured to cooperate with a first set of the HOF scattering members to produce a fifth signal having the first polarization. A second impedance-matching dipole may be associated with the second conductive probe and may have the second orientation. The second impedance-matching dipole may be configured to cooperate with a second set of the HOF scattering members to produce a sixth signal having the second polarization.

Further, in some embodiments, the radiating element may include a second metallization layer positioned between the ground layer and the metallization layer. The second metallization layer may include HOF scattering members. A first impedance-matching dipole may be associated with the first conductive probe and may have the first orientation. The first impedance-matching dipole may be configured to cooperate with a first set of the HOF scattering members to produce a third signal having the first polarization. A second impedance-matching dipole may be associated with the second conductive probe and may have the second orientation. The second impedance-matching dipole may be configured to cooperate with a second set of the HOF scattering members to produce a fourth signal having the second polarization.

In a further aspect, the inventive concepts disclosed herein are directed to an electronically scanned array radiating element. The radiating element includes a ground plane layer having a first conductive probe and a second conductive probe.

A lower metallization layer is coupled with the ground plane layer and includes HOF scattering members and a first impedance-matching dipole associated with the first conductive probe and having a first orientation. The first impedance-matching dipole may be configured to cooperate with a first set of the HOF scattering members to produce a first signal having a first polarization. A second impedance-matching dipole may be associated with the second conductive probe and may have a second orientation substantially orthogonal to the first orientation. The second impedance-matching dipole may be configured to cooperate with a second set of the HOF scattering members to produce a second signal having a second polarization substantially orthogonal to the first polarization.

A mid-metallization layer may be coupled with the ground plane layer and with the lower metallization layer. The mid-metallization layer may include HOF scattering members and a first probe-receiving space coupled with the first vertical probe. A first cluster of impedance-matching dipoles may be associated with the first probe receiving space and may be configured to cooperate with a third set of the HOF scattering members to produce a third signal having the first polarization. A second probe-receiving space may be coupled with the second conductive probe. A second cluster of impedance-matching dipoles may be associated with the second probe-receiving space and may be configured to cooperate with a fourth set of the HOF scattering members to produce a fourth signal having the second polarization.

An upper metallization layer may be coupled with the ground plane layer, the lower metallization layer, and the mid-metallization layer. The upper metallization layer may include a first asymmetric cluster including HOF scattering members and impedance-matching dipoles. A first electrically-large impedance-matching dipole having the first orientation may be coupled with the first conductive probe and may be associated with the first asymmetric cluster. The first electrically-large impedance-matching dipole and the first asymmetric cluster may cooperate with one another to produce a fifth signal having the first polarization. A second asymmetric cluster includes HOF scattering members and impedance-matching dipoles. A second electrically-large impedance-matching dipole having the second orientation may be coupled with the second conductive probe and may be associated with the second asymmetric cluster. The second electrically-large impedance-matching dipole and the second asymmetric cluster may cooperate with one another to produce a sixth signal having the second polarization.

In a further aspect, the inventive concepts disclosed herein are directed to an electronically scanned array (ESA) system. The system may include an electronically scanned array radiating element. The radiating element may have a ground plane layer including a first conductive probe and a second conductive probe. A metallization layer may be coupled with the ground plane layer. The metallization layer may include a first asymmetric cluster including HOF scattering members and impedance-matching dipoles. A first electrically-large impedance-matching dipole having a first orientation may be coupled with the first conductive probe and associated with the first asymmetric cluster. The first electrically-large impedance-matching dipole and the first asymmetric cluster may cooperate with one another to produce a first signal having a first polarization. A second asymmetric cluster may including HOF scattering members and impedance-matching dipoles. A second electrically-large impedance-matching dipole having a second orientation substantially orthogonal to the first orientation may be coupled with the second conductive probe and associated with the second asymmetric cluster. The second electrically-large impedance-matching dipole and the second asymmetric cluster may cooperate with one another to produce a second signal having a second polarization orthogonal to the first polarization. A radome layer may be coupled with the upper metallization layer.

In some embodiments, the radiating element may also include a second metallization layer positioned between the ground plane layer and the metallization layer. The second metallization layer may include HOF scattering members. A first probe-receiving space may be coupled with the first conductive probe. A first cluster of impedance-matching dipoles may be associated with the first probe receiving space and may be configured to cooperate with a third set of the HOF scattering members to produce a third signal having the first polarization. A second probe-receiving space may be coupled with the second conductive probe. A second cluster of impedance-matching dipoles may be associated with the second probe-receiving space and may be configured to cooperate with a fourth set of the HOF scattering members to produce a fourth signal having the second polarization.

Further, in some embodiments, the radiating element may further include a third metallization layer positioned between the ground plane layer and the second metallization layer. The third metallization layer may include HOF scattering members. A first impedance-matching dipole may be associated with the first conductive probe and may have the first orientation. The first impedance-matching dipole may be configured to cooperate with a first set of the HOF scattering members to produce a fifth signal having the first polarization. A second impedance-matching dipole may be associated with the second conductive probe and may have the second orientation. The second impedance-matching dipole may be configured to cooperate with a second set of the HOF scattering members to produce a sixth signal having the second polarization.

Further, in some embodiments the radiating element may include a second metallization layer positioned between the ground plane layer and the metallization layer. The second metallization layer may include HOF scattering members. A first impedance-matching dipole may be associated with the first conductive probe and may have the first orientation. The first impedance-matching dipole may be configured to cooperate with a first set of the HOF scattering members to produce a third signal having the first polarization. A second impedance-matching dipole may be associated with the second conductive probe and may have the second orientation. The second impedance-matching dipole may be configured to cooperate with a second set of the HOF scattering members to produce a fourth signal having the second polarization.

BRIEF DESCRIPTION OF THE DRAWINGS

Like reference numerals in the figures may represent and refer to the same or similar element or function. Implementations of the inventive concepts disclosed herein may be better understood when consideration is given to the following detailed description thereof. Such description makes reference to the annexed pictorial illustrations, schematics, graphs, drawings, and appendices, which are not necessarily to scale, and in which some features may be exaggerated and some features may be omitted or may be represented schematically in the interest of clarity. In the drawings.

DETAILED DESCRIPTION OF EXEMPLARY EMBODIMENTS

Figure 1:
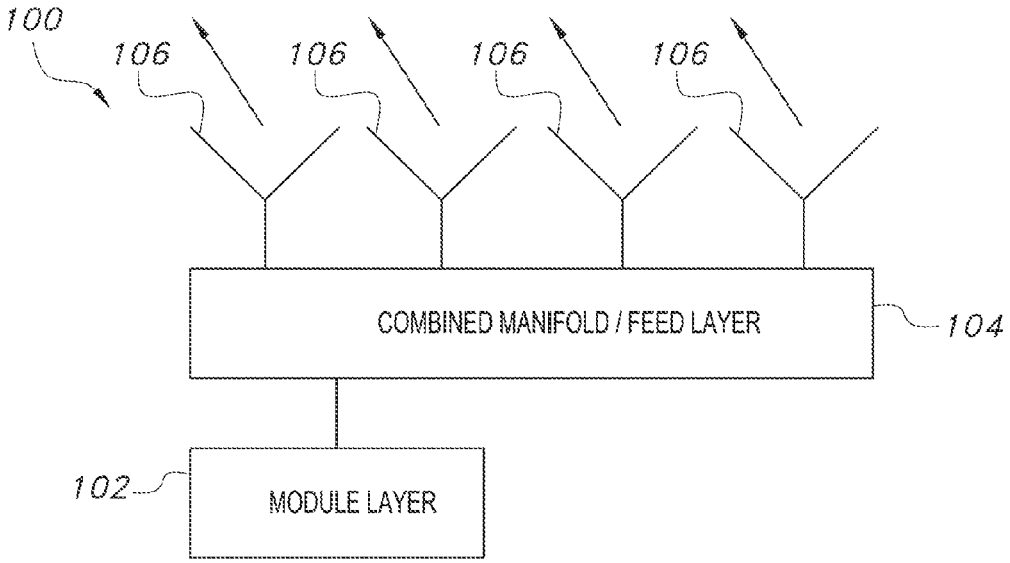
FIG. 1 shows a block diagram of an exemplary embodiment of an antenna system according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a' and "an" are intended to include one or at least one and the singular also includes the plural unless it is obvious that it is meant otherwise.

Finally, as used herein any reference to "some embodiments,' "one embodiment," or "an embodiment" means that a particular element, feature, structure, or characteristic described in connection with the embodiment is included in at least one embodiment. The appearances of the phrase "in some embodiments" in various places in the specification are not necessarily all referring to the same embodiment, and embodiments of the inventive concepts disclosed may include one or more of the features described herein, or any combination of sub-combination of two or more such features, along with any other features which may not necessarily be described or inherently present in the instant disclosure.

Broadly, the inventive concepts disclosed herein are directed to dual polarized probe coupled radiating elements. In some embodiments, dual polarized probe coupled radiating elements according to the inventive concepts disclosed herein may be implemented in antenna systems for satellite communication applications.

Dual polarized probe coupled radiating elements according to the inventive concepts disclosed herein may utilize higher order Floquet scattering and impedance matching to provide improved scan performance, wider bandwidth, and increased unit cell size.

Referring to FIG. 1, a block diagram of an antenna system 100 according to an exemplary embodiment of the inventive concepts disclosed herein is shown. The antenna system 100 includes a module layer 102, a combined manifold/feed layer 104 connected to the module layer 102, and a layer of radiating element unit cells 106 connected to the combined manifold/feed layer 104. Each radiating element unit cell 106 is configured to generate two orthogonally polarized fields. The radiating element unit cells 106 include layers of epoxy-based material with printed circuit patterns. The coupling from the radiating element unit cell 106 to the combined manifold/feed layer 104 is via two vertical probes connecting the combined manifold/feed layer 100 to one or more metallization layers as described herein.

In some embodiments, the radiating element unit cells 106 may be implemented as active electronically scanned antennas 106. An active electronically scanned antenna 106 having two probe-fed inserts offers significant advantages in cost and packaging. Because probe feeds occupy substantially less area than stripline feeds, the manifold and feed layers may be combined into a combined manifold/feed layer 106. Combining the manifold and feed layers eliminates the separate stripline feed layer, reduces material costs and obviates a series of back drill and fill operations. A lamination step is also eliminated which further lowers manufacturing costs and improves via reliability over temperature cycles.

Figure 2:
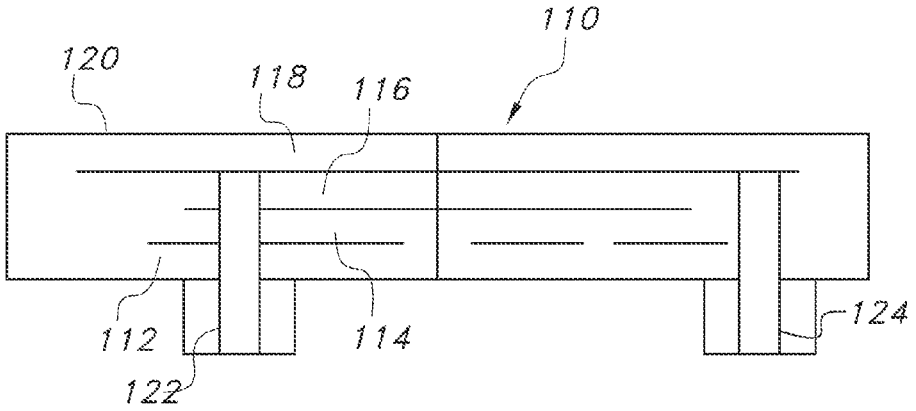
FIG. 2 shows a cross-sectional side view of an exemplary embodiment of a radiating element according to the inventive concepts disclosed herein with two penetrating vertical probes.

Referring to FIG. 2, a cross-sectional side view of a radiating element 110 according to embodiments of the present invention with two penetrating vertical probes is shown. The radiating element 110 has a number of printed circuit board layers which include a high dielectric epoxy material suitable for standard printed wiring board manufacturing processes such as FR-4. The printed circuit board is balanced to reduce warping.

The radiating element 110 includes a ground plane layer 112, a lower metallization layer 114, a mid-metallization layer 116, an upper metallization layer 118, and a radome layer 120. Two conductive probes 122 and 124 connect all metallized layers to the ground plane layer 112 and excite the lower metallization layer 114. The conductive probes 122 and 124 connect all metal layers facilitating manufacturing. It is to be understood that in some embodiments, one or more of the lower metallization layer 114, the mid-metallization layer 116, or the upper metallization layer 118 may be omitted. Further, in some embodiments, additional metallized layers may be implemented with or substituted for one or more of the lower metallization layer 114, the mid-metallization layer 116, or the upper metallization layer 118.

In some embodiments, the substrate of the radiating element 110 may have a height of 50 mils. In some embodiments, the substrate material is epoxy-based, having a dielectric constant of 3.7, and loss tangent of 0.008. In one embodiment, the unit cell size is 0.275 $\lambda^2$ at 14.5 GHz. Radiating elements according to the inventive concepts disclosed herein may have scan performance less than −10 dB return loss out of 30° half conical scan angle for arbitrary phi angle (e.g., between 0° and 360°). In some embodiments, radiating element 110 may be configured to operate in a frequency range of 10.7 to 14.5 GHz with scan volume from 0° to 30° over all phi angles.

The radome layer 120 may include a layer of standard epoxy (FR-4) applied at the end of the manufacturing process to protect the underlying metal layers. The FR-4 may be applied without excessively warping (colloquially referred to as potato chipping) the radiating element 110 substrate because the underlying layers are balanced.

Figure 3:
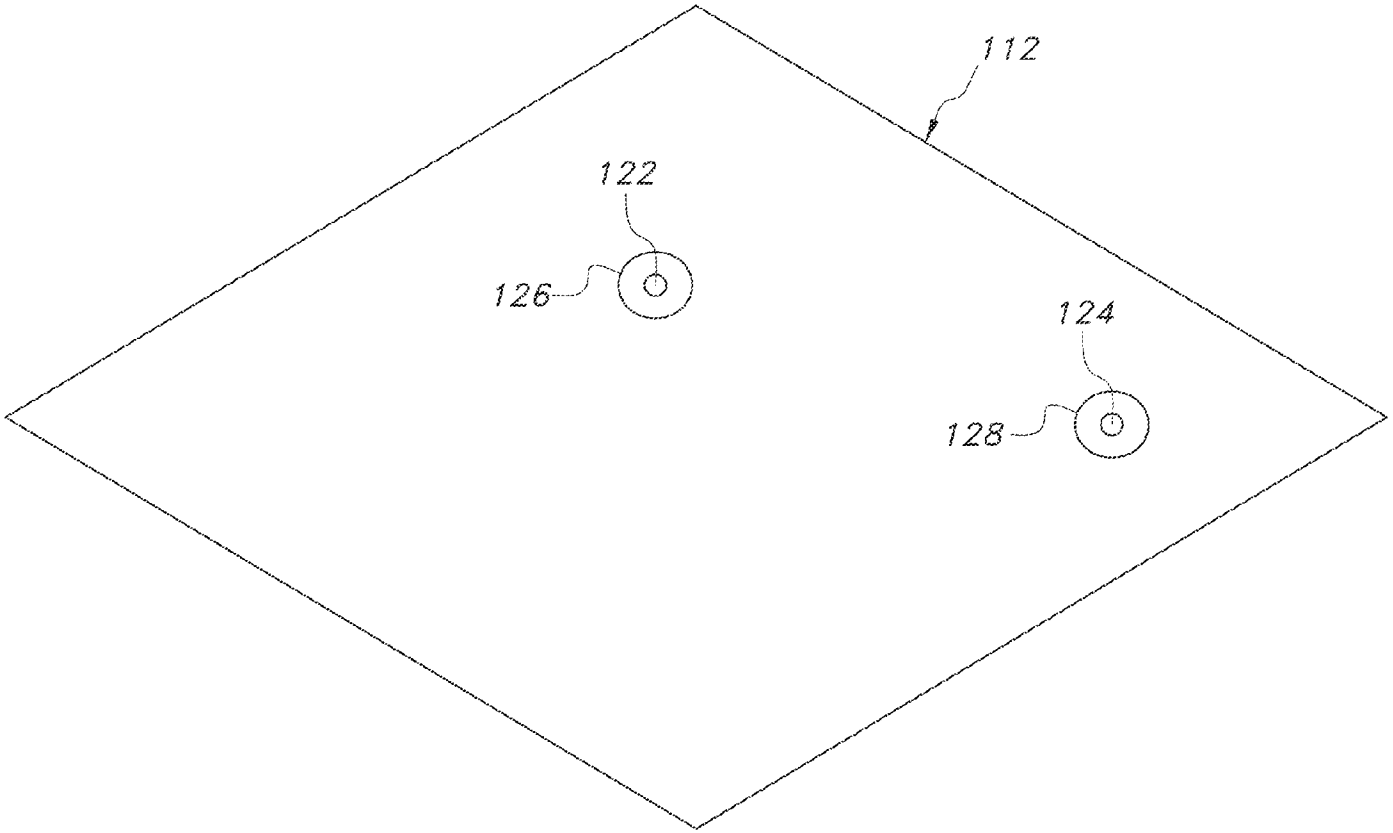
FIG. 3 shows a top view of an exemplary embodiment of a ground plane of a radiating element according to the inventive concepts disclosed herein.

Referring to FIG. 3, a top view of the ground plane layer 112 of the radiating element 110 is shown. The ground plane layer 112 defines two openings 126 and 128 each shaped to conform to the conductive probes 122 and 124 connecting the metallized layers of the radiating element 110. The location of each vertical probe 122 and 124 may be determined in relation to the gain of the radiating element 110 with respect to the metallic layers and the final geometry of the High-Order Floquet scattering members and impedance-matching dipoles of the radiating element 110 as described below.

Figure 4:
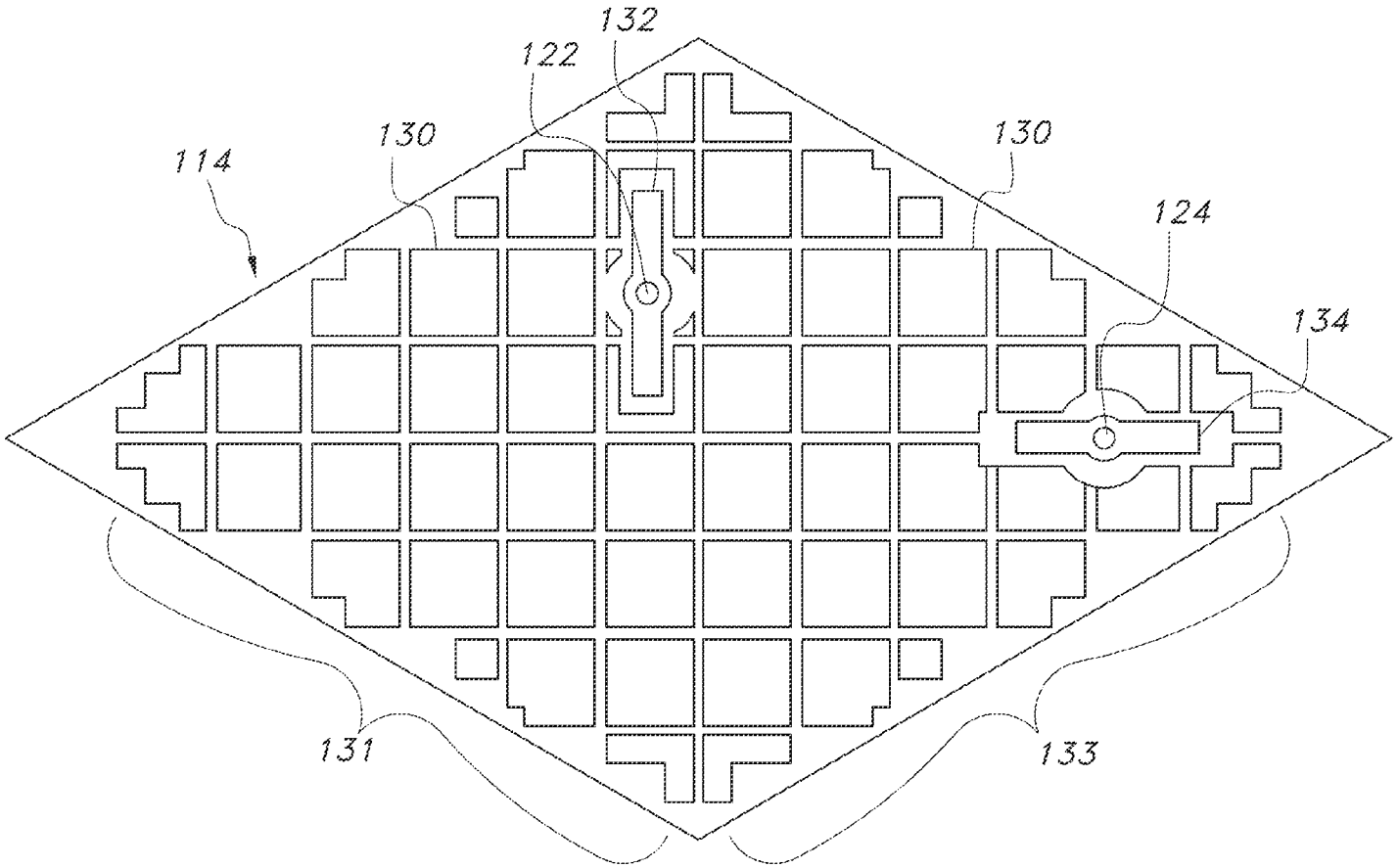
FIG. 4 shows a top view of an exemplary embodiment of a lower metallization layer of a radiating element according to the inventive concepts disclosed herein.

Referring to FIG. 4, a top view of the lower metallization layer 114 of the radiating element 110 according to embodiments of the inventive concepts disclosed herein is shown. The lower metallization layer 114 includes a plurality of Higher-Order Floquet (HOF) scattering members 130 and two impedance-matching dipoles 132 and 134 organized to tune the radiating element 110 in a particular frequency range.

The HOF scattering members 130 may be implemented as metallic or conductive strips, inclusions, or structures, embedded in, positioned on, or otherwise coupled with the substrate material of the lower metallization layer 114. The HOF scattering members 130 may have any desired shape, such as square, triangular, L-shaped, M-shaped, irregular, or combinations thereof. The HOF scattering members 130 are desirably electrically-small (e.g., having sizes, lengths, widths, or diameters on the order of about 0.1 of an operational wavelength or spectrum for which the radiating element 110 is optimized or configured).

The impedance-matching dipoles 132 and 134 may be implemented as elongated (e.g., rectangular or strips) metallic or conductive structures, members, or inclusions embedded in, positioned on, or otherwise coupled with the substrate material of the lower metallization layer 114. The impedance-matching dipole 132 and the impedance-matching dipole 134 are oriented generally perpendicular or orthogonally relative to one another. The impedance-matching dipole 132 is coupled with the conductive probe 122, and the impedance-matching dipole 134 is coupled with the conductive probe 124.

The impedance-matching dipole 132 is oriented along an axis or direction as shown in FIG. 4. The impedance-matching dipole 132 and a set 131 (e.g., a portion) of the plurality of HOF scattering members 130 may be configured, sized, spaced, and arranged so as to cooperate with one another to produce a signal having a known polarization. Similarly, the impedance-matching dipole 134 may be oriented along an axis generally perpendicular or substantially orthogonal relative to the axis of the impedance-matching dipole 132. Further, the impedance-matching dipole 134 and a set 133 (e.g., a portion) of the plurality of HOF scattering members 130 may be configured, sized, spaced, and arranged so as to cooperate with one another to produce a signal having a known polarization which may be generally perpendicular or orthogonal relative to the polarization of the signal produced by the impedance-matching dipole 132 and the set 131 of the plurality of HOF scattering members 130.

Figure 5:
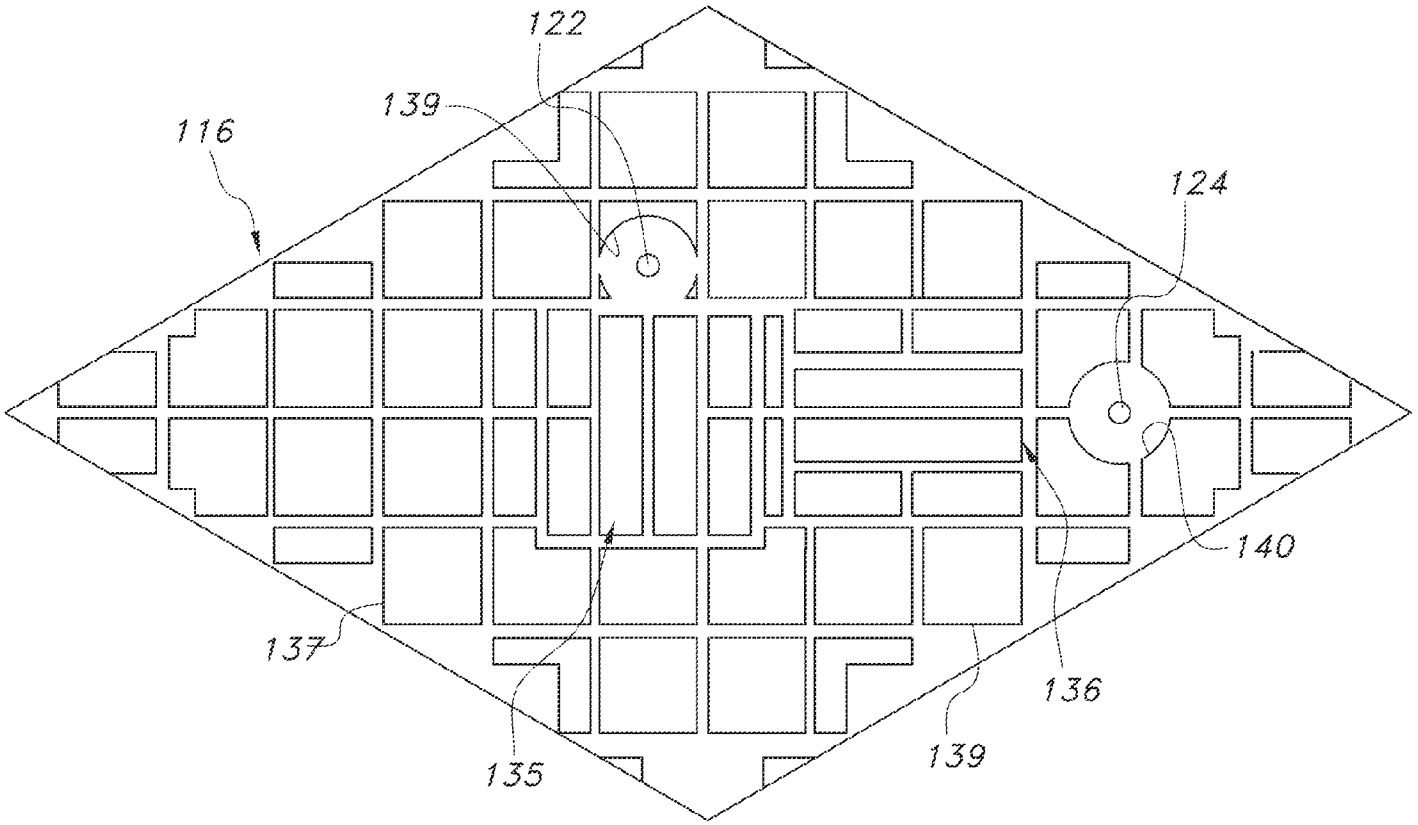
FIG. 5 shows a top view of an exemplary embodiment of a mid-metallization layer of a radiating element according to the inventive concepts disclosed herein.

Referring to FIG. 5, a top view of the mid-metallization layer 116 of the radiating element 110 is shown. The mid-metallization layer 116 includes two sets of impedance-matching dipoles 135 and 136 and two sets of HOF scattering members 137 and 138, organized for a wide angle scan. The mid-metallization layer 116 may also include two vertical probe receiving areas 139 and 140 for receiving the conductive probes 122 and 124 therein, respectively. The conductive probe 122 is coupled with the probe receiving area 139 and the conductive probe 124 is coupled with the probe receiving area 140.

The impedance-matching dipoles 135 and 136 may be implemented and may function similarly to the impedance-matching dipoles 132 and 134, and the HOF scattering members 137 and 138 may be implemented and may function similarly to the HOF scattering members 130.

The set or impedance-matching dipoles 135 is associated with the probe receiving area 139. The set of impedance-matching dipoles 135 may be excited by signals from the lower metallization layer 114 and is configured so as to cooperate with the set of HOF scattering members 137 to produce a signal which may have the same polarization as the signal produced by the impedance-matching dipole 132 and the set 131 of HOF scattering members 130 of the lower metallization layer 114.

Similarly, the set of impedance-matching dipoles 136 is associated with the probe receiving area 140. The set of impedance-matching dipoles 136 may be excited by signals from the lower metallization layer 114 and is configured so as to cooperate with the set of HOF scattering members 138 to produce a signal which may have the same polarization as the signal produced by the impedance-matching dipole 134 and the set 133 of HOF scattering members 130 of the lower metallization layer 114. It is to be understood that in some embodiments, the lower metallization layer 114 may be omitted, and the mid-metallization layer may be energized by the conductive probes 122 and 124.

Figure 6:
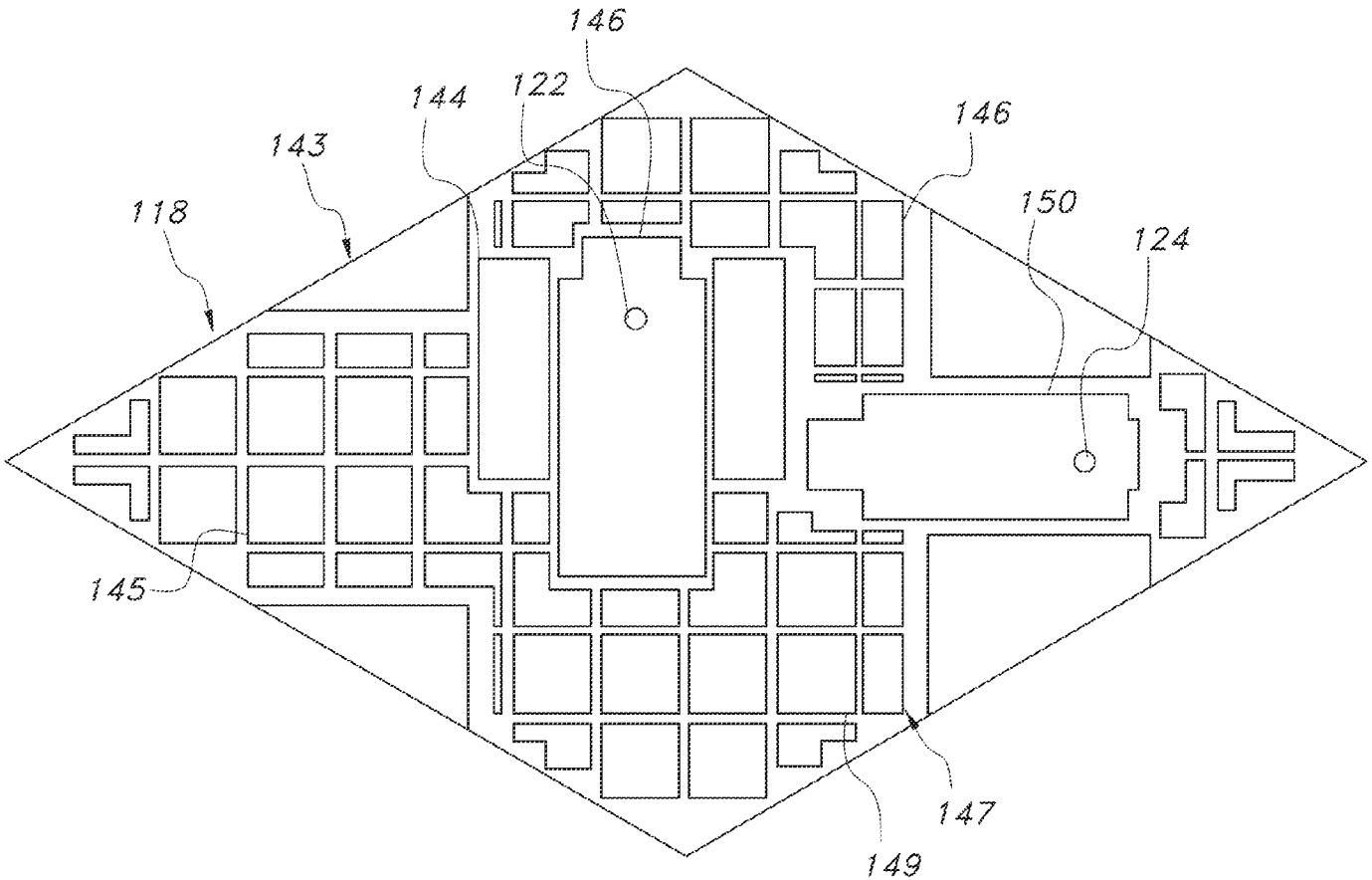
FIG. 6 shows a top view of an exemplary embodiment of an upper metallization layer of a radiating element according to the inventive concepts disclosed herein.

Referring to FIG. 6, a top view of the upper metallization layer 118 of the radiating element 110 is shown. The upper metallization layer 118 has an asymmetric cluster 143 including a plurality of impedance-matching dipoles 144 and a plurality of HOF scattering members 145 organized for wide angle scan. The plurality of impedance matching dipoles 144 may be implemented and may function similarly to the impedance matching dipoles 135 and 136, and the plurality of HOF scattering members 145 may be implemented and may function substantially similarly to the HOF scattering members 130. An electrically-large impedance-matching dipole 146 (e.g., having a size greater than or equal to about 0.25 of the wavelength or spectrum for which the radiating element 110 is configured) is coupled with the conductive probe 122 and is associated with the asymmetric cluster 143. The electrically-large impedance-matching dipole 146 and the asymmetric cluster 143 may be excited by signals from the lower metallization layer 114, signals from the mid-metallization layer 116, and/or signals from the vertical probe 122 so that the electrically-large impedance-matching dipole 146 and the asymmetric cluster 143 cooperate with one another to produce a signal having the same polarization as the signal produced by the set of impedance-matching dipoles 135 and the set of HOF scattering members 137 of the mid-metallization layer 116. It is to be understood that in some embodiments the mid-metallization layer 116 may be omitted and the upper metallization layer 118 may be excited by signals from the lower metallization layer 114. Further, in some embodiments, both the lower metallization layer 114 and the mid-metallization layer 116 may be omitted, and the upper metallization layer 118 may be excited by signals from the conductive probes 122 and 124.

The upper metallization layer 118 also includes an asymmetric cluster 147 including a plurality of impedance-matching dipoles 148 and a plurality of HOF scattering members 149 organized for a wide angle scan. An electrically large impedance-matching dipole 150 (e.g., having a size greater than or equal to about 0.25 of the wavelength or spectrum for which the radiating element 110 is configured) is coupled with the conductive probe 124 and is associated with the asymmetric cluster 147. The electrically-large impedance-matching dipole 150 is oriented substantially orthogonally to the electrically-large impedance-matching dipole 146. The electrically-large impedance-matching dipole 150 and the asymmetric cluster 147 may be excited by signals from the lower metallization layer 114, signals from the mid-metallization layer 116, and/or signals from the vertical probe 124 so that the electrically-large impedance-matching dipole 150 and the asymmetric cluster 147 cooperate with one another to produce a signal having the same polarization as the signal produced by the set of impedance-matching dipoles 136 and the set of HOF scattering members 138 of the mid-metallization layer 116.

A person skilled in the art having the benefit of the instant disclosure will appreciate that while the exemplary embodiment described herein is specifically directed toward impedance-matching dipoles 144 organized into clusters 152 and 154 in the upper metallization layer 118, impedance-matching dipoles organized into clusters in other metallization layers may also be effective in producing per-unit-cell dual polarization. Radiating elements according to embodiments of the inventive concepts disclosed herein may produce a per-unit-cell dual polarized signal suitable for satellite communication.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. An electronically scanned array radiating element comprising:

a ground plane layer including a first conductive probe and a second conductive probe; and at least one metallization layer coupled with the ground plane layer and including:

a first asymmetric cluster including a first plurality of HOF scattering members and a first plurality of impedance-matching dipoles;

a first electrically-large impedance-matching dipole having a first orientation and being coupled with the first conductive probe and associated with the first asymmetric cluster so that the first electrically-large impedance-matching dipole and the first asymmetric cluster cooperate with one another to produce a first signal having a first polarization;

a second asymmetric cluster including a second plurality of HOF scattering members and a second plurality of impedance-matching dipoles; and a second electrically-large impedance-matching dipole having a second orientation substantially orthogonal to the first orientation and being coupled with the second conductive probe and associated with the second asymmetric cluster so that the second electrically-large impedance-matching dipole and the second asymmetric cluster cooperate with one another to produce a second signal having a second polarization orthogonal to the first polarization.

2. The radiating element of claim 1, wherein the at least one metallization layer comprises a printed circuit pattern on epoxy material.

3. The radiating element of claim 1, wherein the first and second plurality of HOF scattering members are electrically-small HOF scattering members.

4. The radiating element of claim 1, further comprising at least one radome layer coupled with the at least one metallization layer.

5. The radiating element of claim 1, wherein the at least one metallization layer is at least one first metallization layer, and further comprising at least one second metallization layer positioned between the ground plane layer and the at least one first metallization layer, the at least one second metallization layer comprising:

a third plurality of HOF scattering members;

a first probe-receiving space coupled with the first conductive probe;

a first cluster of impedance-matching dipoles associated with the first probe receiving space and configured to cooperate with a third set of the third plurality of HOF scattering members to produce a third signal having the first polarization;

a second probe-receiving space coupled with the second conductive probe; and a second cluster of impedance-matching dipoles associated with the second probe-receiving space and configured to cooperate with a fourth set of the third plurality of HOF scattering members to produce a fourth signal having the second polarization.

6. The radiating element of claim 5, further comprising a third metallization layer positioned between the ground plane layer and the at least one second metallization layer, the third metallization layer comprising:

a fourth plurality of HOF scattering members;

a first impedance-matching dipole associated with the first conductive probe and having the first orientation, the first impedance-matching dipole configured to cooperate with a first set of the fourth plurality of HOF scattering members to produce a fifth signal having the first polarization; and a second impedance-matching dipole associated with the second conductive probe and having the second orientation, the second impedance-matching dipole configured to cooperate with a second set of the fourth plurality of HOF scattering members to produce a sixth signal having the second polarization.

7. The radiating element of claim 1, wherein the at least one metallization layer is at least one first metallization layer, further comprising at least one second metallization layer positioned between the ground layer and the at least one first metallization layer, the at least one second metallization layer including:

a third plurality of HOF scattering members;

a first impedance-matching dipole associated with the first conductive probe and having the first orientation, the first impedance-matching dipole configured to cooperate with a first set of the third plurality of HOF scattering members to produce a third signal having the first polarization; and a second impedance-matching dipole associated with the second conductive probe and having the second orientation, the second impedance-matching dipole configured to cooperate with a second set of the third plurality of HOF scattering members to produce a fourth signal having the second polarization.

8. An electronically scanned array radiating element comprising:

a ground plane layer including a first conductive probe and a second conductive probe; and a lower metallization layer coupled with the ground plane layer and including:

a first plurality of HOF scattering members;

a first impedance-matching dipole associated with the first conductive probe and having a first orientation, the first impedance-matching dipole configured to cooperate with a first set of the first plurality of HOF scattering members to produce a first signal having a first polarization; and a second impedance-matching dipole associated with the second conductive probe and having a second orientation substantially orthogonal to the first orientation, the second impedance-matching dipole configured to cooperate with a second set of the first plurality of HOF scattering members to produce a second signal having a second polarization substantially orthogonal to the first polarization;

a mid-metallization layer coupled with the ground plane layer and with the lower metallization layer, the mid-metallization layer including:

a second plurality of HOF scattering members;

a first probe-receiving space coupled with the first vertical probe;

a first cluster of impedance-matching dipoles associated with the first probe receiving space and configured to cooperate with a third set of the second plurality of HOF scattering members to produce a third signal having the first polarization;

a second probe-receiving space coupled with the second conductive probe; and a second cluster of impedance-matching dipoles associated with the second probe-receiving space and configured to cooperate with a fourth set of the second plurality of HOF scattering members to produce a fourth signal having the second polarization; and an upper metallization layer coupled with the ground plane layer, the lower metallization layer, and the mid-metallization layer, the upper metallization layer including:

a first asymmetric cluster including a third plurality of HOF scattering members and a third plurality of impedance-matching dipoles;

a first electrically-large impedance-matching dipole having the first orientation and being coupled with the first conductive probe and associated with the first asymmetric cluster so that the first electrically-large impedance-matching dipole and the first asymmetric cluster cooperate with one another to produce a fifth signal having the first polarization;

a second asymmetric cluster including a fourth plurality of HOF scattering members and a fourth plurality of impedance-matching dipoles; and a second electrically-large impedance-matching dipole having the second orientation and being coupled with the second conductive probe and associated with the second asymmetric cluster so that the second electrically-large impedance-matching dipole and the second asymmetric cluster cooperate with one another to produce a sixth signal having the second polarization.

9. The radiating element of claim 8, wherein each of the lower metallization layer, mid-metallization layer, and upper metallization layer comprise a printed circuit pattern on epoxy material.

10. The radiating element of claim 8, wherein the first, second, third, and fourth plurality of HOF scattering members are electrically-small HOF scattering members.

11. An electronically scanned array (ESA) system, comprising:

an electronically scanned array radiating element, including:

a ground plane layer including a first conductive probe and a second conductive probe; and at least one metallization layer coupled with the ground plane layer and including:

a first asymmetric cluster including a first plurality of HOF scattering members and a first plurality of impedance-matching dipoles;

a first electrically-large impedance-matching dipole having a first orientation and being coupled with the first conductive probe and associated with the first asymmetric cluster so that the first electrically-large impedance-matching dipole and the first asymmetric cluster cooperate with one another to produce a first signal having a first polarization;

a second asymmetric cluster including a second plurality of HOF scattering members and a second plurality of impedance-matching dipoles; and a second electrically-large impedance-matching dipole having a second orientation substantially orthogonal to the first orientation and being coupled with the second conductive probe and associated with the second asymmetric cluster so that the second electrically-large impedance-matching dipole and the second asymmetric cluster cooperate with one another to produce a second signal having a second polarization orthogonal to the first polarization; and a radome layer coupled with the upper metallization layer.

12. The electronically scanned array system of claim 11, wherein the radome layer comprises a layer of epoxy material.

13. The electronically scanned array system of claim 11, wherein the at least one metallization layer comprises a printed circuit pattern on epoxy material.

14. The electronically scanned array system of claim 11, further comprising a module layer connected to the ground pane layer, the module layer configured to apply a signal to the ground plane layer and thereby to the first conductive probe and the second conductive probe.

15. The electronically scanned array system of claim 11, wherein the at least one metallization layer is at least one first metallization layer, and further comprising at least one second metallization layer positioned between the ground plane layer and the at least one first metallization layer, the at least one second metallization layer comprising:

a third plurality of HOF scattering members;

a first probe-receiving space coupled with the first conductive probe;

a first cluster of impedance-matching dipoles associated with the first probe receiving space and configured to cooperate with a third set of the third plurality of HOF scattering members to produce a third signal having the first polarization;

a second probe-receiving space coupled with the second conductive probe; and a second cluster of impedance-matching dipoles associated with the second probe-receiving space and configured to cooperate with a fourth set of the third plurality of HOF scattering members to produce a fourth signal having the second polarization.

16. The electronically scanned array system of claim 15, further comprising at least one third metallization layer positioned between the ground plane layer and the at least one second metallization layer, the at least one third metallization layer comprising:

a fourth plurality of HOF scattering members;

a first impedance-matching dipole associated with the first conductive probe and having the first orientation, the first impedance-matching dipole configured to cooperate with a first set of the fourth plurality of HOF scattering members to produce a fifth signal having the first polarization; and a second impedance-matching dipole associated with the second conductive probe and having the second orientation, the second impedance-matching dipole configured to cooperate with a second set of the fourth plurality of HOF scattering members to produce a sixth signal having the second polarization.

17. The electronically scanned array system of claim 11, wherein the at least one metallization layer is at least one first metallization layer, further comprising at least one second metallization layer positioned between the ground plane layer and the at least one first metallization layer, the at least one second metallization layer including:

a third plurality of HOF scattering members;

a first impedance-matching dipole associated with the first conductive probe and having the first orientation, the first impedance-matching dipole configured to cooperate with a first set of the third plurality of HOF scattering members to produce a third signal having the first polarization; and a second impedance-matching dipole associated with the second conductive probe and having the second orientation, the second impedance-matching dipole configured to cooperate with a second set of the third plurality of HOF scattering members to produce a fourth signal having the second polarization.

* * * * *